US008596638B2

(12) United States Patent
Owoc

(10) Patent No.: US 8,596,638 B2
(45) **Date of Patent: *Dec. 3, 2013**

(54) ROTATABLE HAND GRIP SYSTEM

(76) Inventor: Greg John Owoc, Greenville, SC (US)

( * ) Notice: Subject to any disclaimer, the term of this patent is extended or adjusted under 35 U.S.C. 154(b) by 88 days.

This patent is subject to a terminal disclaimer.

(21) Appl. No.: 12/931,666

(22) Filed: Feb. 8, 2011

(65) Prior Publication Data

US 2012/0200033 A1 Aug. 9, 2012

(51) Int. Cl.
*A63B 71/00* (2006.01)

(52) U.S. Cl.
USPC ..... 273/142 JA

(58) Field of Classification Search
USPC ..... 273/142 JA
See application file for complete search history.

(56) References Cited

U.S. PATENT DOCUMENTS

| | | | | | |
|---|---|---|---|---|---|
| 270,362 | A | | 1/1883 | Alpress | |
| 614,418 | A | | 11/1898 | Blount | |
| 1,812,946 | A | * | 7/1931 | Grubb | 472/14 |
| 1,990,859 | A | | 2/1935 | Elliott | |
| 2,003,979 | A | | 6/1935 | Skoric | |
| D99,024 | S | * | 3/1936 | Hines | D21/374 |
| 2,077,124 | A | | 7/1936 | Miller et al. | |
| 2,573,475 | A | * | 10/1951 | McFarland | 74/557 |
| 2,881,638 | A | * | 4/1959 | Taylor | 74/552 |
| 3,941,389 | A | * | 3/1976 | Guimond | 273/142 HA |
| 4,210,331 | A | | 7/1980 | Kulesza et al. | |
| 4,492,378 | A | * | 1/1985 | Williams | 273/142 HA |
| 4,687,218 | A | * | 8/1987 | Okamoto | 280/250.1 |
| 4,813,676 | A | | 3/1989 | Weatherspoon | |
| 4,834,385 | A | | 5/1989 | Jackson | |
| 5,164,821 | A | | 11/1992 | Tanaka et al. | |
| 5,188,363 | A | * | 2/1993 | Marnell et al. | 463/13 |
| 5,320,372 | A | * | 6/1994 | Langen | 280/207 |
| 5,340,214 | A | | 8/1994 | Juzwiak | |
| 5,476,019 | A | * | 12/1995 | Cheever et al. | 74/506 |
| 5,788,573 | A | * | 8/1998 | Baerlocher et al. | 463/16 |
| 5,947,820 | A | * | 9/1999 | Morro et al. | 463/9 |
| 5,989,123 | A | * | 11/1999 | Tosaki et al. | 463/37 |
| 6,276,705 | B1 | * | 8/2001 | Baldwin et al. | 280/250.1 |
| 6,322,074 | B1 | * | 11/2001 | Forrest et al. | 273/272 |

(Continued)

FOREIGN PATENT DOCUMENTS

JP 2005007942 A * 1/2005

OTHER PUBLICATIONS

United States Patent and Trademark Office; Office Action; Office Action from U.S. Appl. No. 12/493,170; copyright and mailing date Apr. 4, 2011, pp. 1-8, publisher United States Patent and Trademark Office, Alexandria, Virginia, USA; (8 pages).

(Continued)

*Primary Examiner* — Kurt Fernstrom
*Assistant Examiner* — Dolores Collins
(74) *Attorney, Agent, or Firm* — Metz Lewis Brodman Must O'Keefe LLC; Neal P Pierotti

(57) ABSTRACT

Safe and novel hand grip systems for manually gripping and spinning gaming wheels or rotatable gaming apparatus are improved by including a lightweight, spoked-frame, rotating-rim gaming wheel that may comprise "snap-fitting" and/or modular electronic-plug-in game play wedge pieces. As well, the improvements also encompass inclusion of a novel optional stationary gaming wheel frame in conjunction with the above said rotating hand grip systems, that itself may include several embodiments and modifications.

20 Claims, 4 Drawing Sheets

(56) References Cited

U.S. PATENT DOCUMENTS

| | | | | |
|---|---|---|---|---|
| 6,389,929 | B1 * | 5/2002 | Calilung et al. | 74/551.9 |
| 6,530,864 | B1 * | 3/2003 | Parks | 482/4 |
| 6,880,855 | B2 * | 4/2005 | Chernoff et al. | 280/778 |
| 7,100,916 | B2 * | 9/2006 | Kelly et al. | 273/138.1 |
| 7,563,097 | B2 * | 7/2009 | Lavigna et al. | 434/16 |
| 7,578,745 | B2 * | 8/2009 | Wingerstahn | 472/18 |
| 7,766,329 | B1 * | 8/2010 | Kelly et al. | 273/138.1 |
| 7,775,870 | B2 * | 8/2010 | Kelly et al. | 463/16 |
| 7,824,252 | B1 * | 11/2010 | Kelly et al. | 463/7 |
| 7,832,727 | B1 * | 11/2010 | Kelly et al. | 273/138.1 |
| D631,930 | S * | 2/2011 | Krauss et al. | D21/830 |
| 7,878,506 | B1 * | 2/2011 | Kelly et al. | 273/138.1 |
| 2002/0149257 | A1 * | 10/2002 | Miansian et al. | 301/74 |
| 2005/0167912 | A1 * | 8/2005 | Sokolov | 273/142 R |
| 2005/0243468 | A1 * | 11/2005 | Miyamoto | 360/137 |
| 2006/0038343 | A1 * | 2/2006 | Adams | 273/143 R |
| 2006/0119036 | A1 * | 6/2006 | Scozio | 273/142 R |
| 2008/0203702 | A1 * | 8/2008 | Noye | 280/304.1 |
| 2009/0139424 | A1 * | 6/2009 | Norman et al. | 105/1.5 |
| 2010/0327523 | A1 * | 12/2010 | Owoc | 273/142 R |

OTHER PUBLICATIONS

United States Patent and Trademark Office; Office Action; Office Action from U.S. Appl. No. 12/493,170; copyright and mailing date Jul. 21, 2011, pp. 1-5, publisher United States Patent and Trademark Office, Alexandria, Virginia, USA; (5 pages).

United States Patent and Trademark Office; Office Action; Office Action from U.S. Appl. No, 12/493,170; copyright and mailing date Oct. 9, 2012, pp. 1-7, publisher United States Patent and Trademark Office, Alexandria, Virginia, USA; (7 pages).

* cited by examiner

ROTATABLE HAND GRIP SYSTEM

BACKGROUND OF THE INVENTION

1. Field of the invention

This invention relates generally to gaming wheels or rotatable gaming apparatus which may be manually spun by a user's hand to select, by chance or by skill, various numbers, colors or other informational fields or sectors on a rotating OR stationary game board or wheel, with rotatable manual gripping means. More specifically, the field of the present invention involves frame structures and improvements and optional means that may be employed to further lessen risk of injury primarily especially because of drastically reduced weight and limited bulk of componentry to rotate by a user's hand, and enhance convenience when actuating or rotating such wheels, aka., Wheel of Fortune® (W of F)," "Games of Chance Wheels," Wheels of Chance, or Prize Wheels. The invention may be further enhanced by inclusion of the above improvements with the inventor's former application: Ser. No. 12/493,170 Dated: Jun. 27, 2009 entitled: Safe and Novel, Lightweight Hand-Grip Systems for Manually Spinning Gaming Wheels.

2. Description of Prior Art

The art of record discloses minimal innovations as to hand grip systems or gripping apparatus that increase safety and simplify the game wheel user's experience. The standard methods or structures that the majority of former art uses is simply to "grab the edge of the rotatable board or wheel" and spin it, whether the spinning axis is perpendicular or parallel to the ground. These wheels use a rotating board that typically comprises an annularly arrayed set of pegs or raised surfaces, most often affixed to their outer peripheries, which rotate with the wheel and strike a flipper or finger-like indicator.

The art of record discloses minimal innovations as to hand grip systems or gripping apparatus that increase safety and simplify the game wheel user's experience. The standard methods or structures that the majority of former art uses is simply to "grab the edge of the rotatable board or wheel" and spin it, whether the spinning axis is perpendicular or parallel to the ground. Also, grabbing long spikes, as the said Wheel of Fortune is another method of spinning, as discussed in the above said former application, of which more improvements of the invention are disclosed herein. These wheels use a rotating board that typically comprises an annularly arrayed set of pegs or raised surfaces, most often affixed to their outer peripheries, which rotate with the wheel and strike a spring-clicking flipper indicator (or multiple flipper indicators, aka. sector identification members) that determines the stop point and informational field or sector which is "played" by the game wheel user. Various wheels whose axis is parallel to the ground are found in U.S. Pat. Nos. 614,418; 2,077,124; 5,164,821; 5,340,214 and others. These are typically activated by simply grasping the side of the wheel by hand then thrusting downward to effect rotation. Other patents or former art disclose use a crank handle to turn the wheel or apparatus, usually for mixing up chance pieces, as bingo balls, are found in U.S. Pat. Nos. 2,003,979; 4,813,676; and 4,834,385. Several chance wheels whose axis is perpendicular to the ground are described in U.S. Pat. Nos. 1,990,859, 4,210,331 and U.S. Design Pat. Des. 270,362.

SUMMARY OF THE PRESENT INVENTION

In view of the formerly discussed disadvantages inherent in the presently known Gaming Wheels, particularly those of the Wheel of Fortune Game Show type, it is an object of the present invention to provide a hand grip system for gaming wheels that provides major improvements to upgrade the former art in the categories of safety, ease of use, elimination or minimization of visual or hand obstruction, minimization of stress, and bodily over-stretching, (particularly for shorter, smaller arm people, upon user when spinning the wheel), minimizing of contestant cheating and finally, convenient electronic signaling of the contestant, and thus would provide overall enhanced pleasure of the game and in his application.

However, as the above improvements were emphasized in the applicant's former application: Ser. No. 12/493,170 Dated: Jun. 27, 2009, it is primarily the additional mass reduction innovations disclosed herein that significantly even moreso reduce the weight of the rotating hand grip system that; 1. In the above former application included a rotating Game Board AND a rotating gripping means combined therewith, but now new art comprises also optionally stressed-spoked or "rigid-spoked" rotating-rim gaming wheel frames with "snap-fitting" and/or modular electronic-plug-in game play wedge pieces -preferably of carbon fiber—Note: This novel improvement was also described in the email dated Jan. 28, 2010 sent 8:06 pm to Sony Corporate and W of F employees and representatives. 2. Now, also, the new art herein and the art of the former said application is disclosed further as having an optional stationary wheel board of several variations and adaptations to the former said application art and the new other spoked game wheel that would include one or more said "flipper-indicators" that also rotate with the said rotatable gaming wheel gripping means. Therefore, it is a purpose to add improvements that would be covered already by the spirit and scope of the former said application, but however need further clarity and development in more detail. As well, it is an another objective to disclose alternate further embodiments in seed form in the former application, as by having that stationary wheel with annular graspable member therefore enhancing the inventor's former application entitled: Safe and Novel, Lightweight Hand-Grip Systems for Manually Spinning Gaming Wheels.

The disclosed new art herein will be seen to include the same informational fields or sectors on a rotating OR stationary game board or wheel, with rotatable manual gripping means or annular graspable member. More specifically, the present invention involves frame structures and improvements and optional means that may be employed to further lessen risk of injury primarily (especially because of drastically reduced weight and limited bulk of componentry) to a user's hand, and enhance convenience when actuating or rotating such wheels, aka., Wheel of Fortune®," "Games of Chance Wheels," Wheels of Chance, or Prize Wheels.

Noting the applicant's former application: Ser. No. 12/493,170 Dated: Jun. 27, 2009, wherein the art, drawings, and description language used in the forgoing new application will use similar terminology and equivalent description and wording, thus avoiding confusion for describing the new art of the present application, wherein the former rotating game board AND a rotating gripping means or annular graspable member combined therewith is still however quite weighty because of the bulky "heavy solid metal framing" that is still used to construct the rotating wheel portion of the device as, for example, in the original art of the Wheel of Fortune said device. While the former application focused on the actual functionally of "manipulating" the manual rotating of the said wheel, the extremely heavy weight is still an issue though, certainly the former application demonstrated weight reducing elements, such as nearly eliminating the entire length of the spikes, as thoroughly discussed therein.

Now, the new art discloses herein of including optionally stressed-spoked or "rigid-spoked" rotating-rim gaming wheel frames, preferably of carbon fiber, a frame that is similar to a "high-quality" carbon fiber racing bicycle wheel that is extremely strong and very easy to spin—Converting such a similar, "stress-spoked" structure to replace the heavy wheel 'base" presently in use on Games Shows, for example Wheel of Fortune, would drop the weight to about $1/5^{th}$ of what it is now and make manual spinning of it by contestants—even still using the present 9" spikes, far easier (though not eliminating their inherent systemic dangers, fully discussed in the former application), but even moreso making simple, elegant and easy to use the manual annular gripping means of former said application.

These spokes could be wire or rod shaped, and also of a rigid form with an I-beam of tubular or ribbed type carbon fiber for strength far superior to steel - - - up to five times, pound for pound—adding even more safety and other obvious advantages that such less weight would have not only for W of F contestants, but for transport of such wheels, the entire mechanism documented as weighing in the 4,000 lb range.

Moreover, "Snap-Fitting" wedge pieces of very many obvious conceptual configurations, foam or sponge materials, hard or flexible polymers, vinyl or various sheathing or films over snap-fitting frames, etc., and such structures can be inserted into the carbon fiber webbed frame, into what may be called captive V-Positions "or captive wedge-positions" on, under, or in between, otherwise attached thereto the spokes (as using rods or wire, or the other rod-like structures discussed above), connecting to a lightweight, preferably carbon fiber wheel rim that alternatively may also support the pins directly onto itself or simply combine with game board base rim and the accompanying attached pins thereon, aka., "annularly arrayed stop position means" and/or modular electronic-plug-in game play wedge pieces.

Now, also, the new art herein and the art of the former said application is disclosed further as having an optional stationary wheel board of several variations and adaptations to the former said application art and to the new other spoked game wheel that would include one or more said "flipper-indicators" that also rotate with the said rotatable gaming wheel gripping means. The new art herein improves further the art of the former said application by also disclosing in addition, an optional stationary wheel board of several variations and adaptations to the former said application art. This wheel system modified would include one or more said "flipper-indicators" that also rotate with the said rotatable gaming wheel gripping means that is further modified to accommodate such re-positioning of said flippers onto the said gripping means aka., annular graspable member of the former application.

The hand grip system comprises a gaming wheel which also comprises a plurality of sectors having informational fields, such fields identifying to the wheel user instruction, or in this case the money amount or gift to be received, usually upon meeting the game conditions and criteria. The major improvement being that the said Wheel is fixed rigidly and non-rotatably to a stationary, lower fixed wheel support, such as a shaft-like stanchion or any spindle, hollow or as a bar-type shaft. It should be noted that even though the gaming wheel is stationary in the New Improvement Art 1 embodiment, it also can, to reduce much weight, have the board wedge modular plug in/fit into place individual wedge pieces as well on a similar web-type frame with similar snap-fitting pieces as described above.

Annularly arrayed stop position means are typically used in the art category of this invention and can be comprised of simple pins, whereby as the wheel user spins the rotatable gaming wheel fields are identified when sector identification members or "flipper" or "fingers", which can also be know as spring-clicking flipper indicators, pass over the pins and eventually stop. One of the essential structural differences of New Improvement Art 1, however, is that the said flippers are NOT fixed with respect to a rotating gaming wheel as in the original W of F design type wheel or the said above former application art, though the former said application clearly anticipates the improvement in its basic application claims. Herein, therefore is described the annular grasping member comprising flippers that are "oscillatingly" (ie., flip back and forth while attached) attached at flipper bases on the said annular graspable member, together ROTATING AROUND with the annular graspable member with respect to that which is in this embodiment, a STATIONARY gaming WHEEL.

Therefore it is a primary objective through the above new structural art to add improvements that additionally reduce weight to the former said application's art, as well as greatly enhancing the ease with which the rotating board or gaming wheel can be manually rotated by contestants or game players, as well as those whose duty it is to maintain the Wheel in working and aesthetic order and excellence. More discussion of variations and alternative structures, improvements and advantages can be understood by reviewing the Detailed Description, below.

The above summary is general and serves as an overview of the invention. Further features and modifications besides those summarized above will be described in the following description. It should be obvious to one skilled in the present art to se possible general or specific modifications that may be substituted for those employed to achieve the purposes of the present invention, while not departing form the scope or spirit of the present invention.

DETAILED DESCRIPTION OF THE PREFERRED EMBODIMENT

Figure 1:
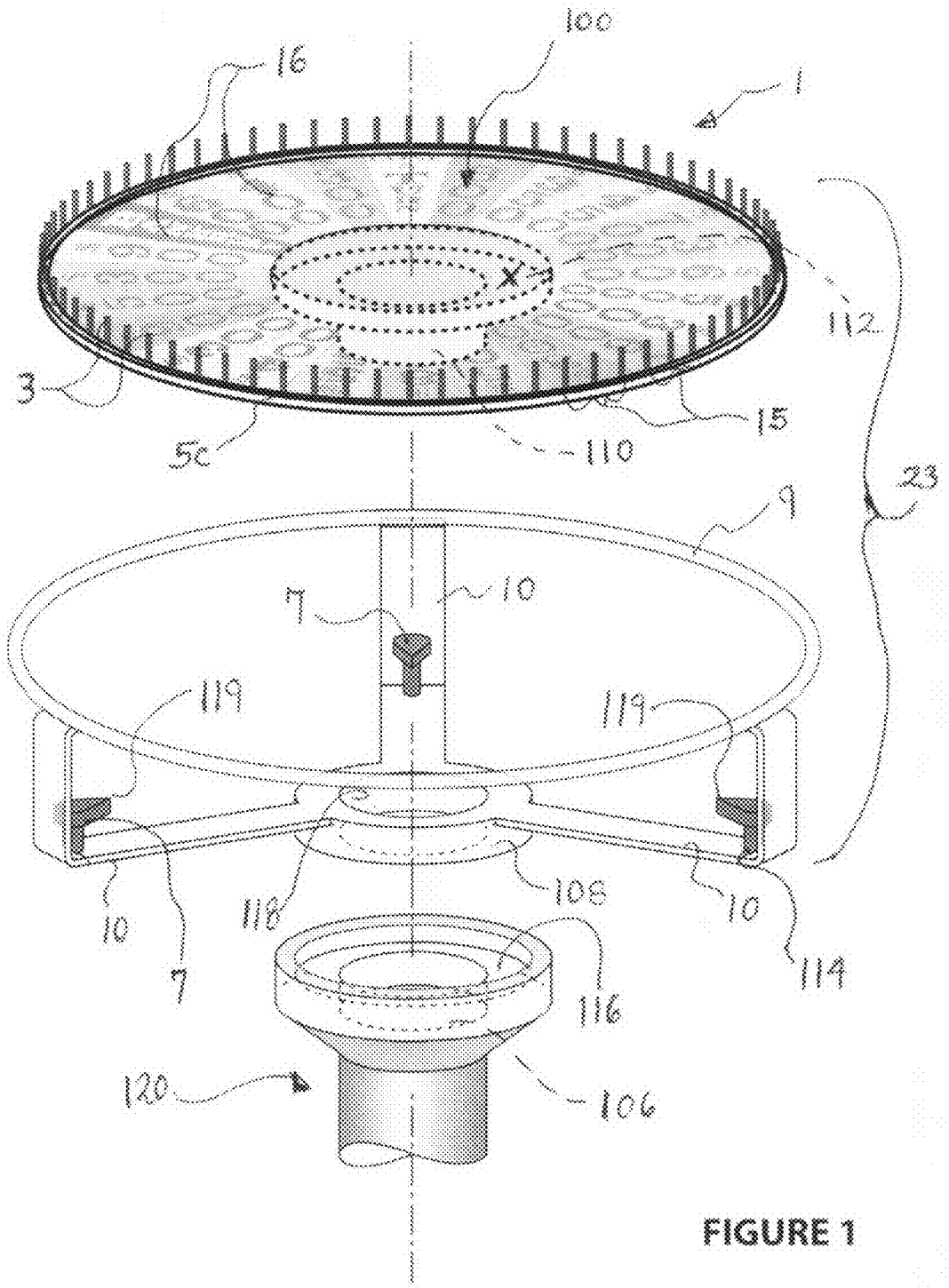
FIG. 1 is an exploded perspective view New Improvement Art 1 of the hand grip system and stationary gaming wheel new art of the present invention.

In describing the preferred embodiments illustrated in the drawings and summarized above, specific terminology shall be resorted to for sake of clarity. However, it is not intended to be limited to the specific terms so selected and it is to be understood that each specific term includes all technical equivalents which operate in a similar manner to accomplish a similar purpose.

With reference to the present invention, (and as well, noting the applicant's former application: Ser. No. 12/493,170

Dated: Jun. 27, 2009, and the reader is directed to refer to much of the same similarly described componentry therein), referring to FIGS. 1 to FIG. 6, particularly to FIGS. 3 and FIG. 4 designated New Improvement Art 2, note hand grip system 23 comprising gaming wheel 1 which comprises a plurality of sectors 15 having informational fields 16, such fields identifying to the wheel user instruction, or in this case the money amount to be received, usually upon meeting the game conditions and criteria.

Annularly arrayed stop position means 3 are typically used in the art category of this invention and can be comprised of simple pins, whereby as the wheel user spins the said rotatable gaming wheel 1 said fields 16 are identified when sector identification members 7, which can also be know as spring-clicking flipper indicators, pass over the said pins 3 and eventually stop, as the said wheel's 1 momentum slows to a halt. Games such as Wheel of Fortune® may use typically three of the said sector identification members 7, one for each of three contestants that typically play the game at a time. Most of these types of said gaming wheels have a game board base 5 or rim into which said pins maybe fixed, providing rigidity to the entire wheel apparatus' structure. Upwardly jutting said support arm 10, aka., annular graspable member support means 10 may be one of many support means used to rigidly support said annular grasping member 9. It is to be noted that the said pins 3 bases 96 would not have to be fixedly attached to the said base rim 5, but rigid, rotating spoked rim 5*b* may take the place of both said rim means 5, 5*b*, and the said pins 3 could be affixed directly thereon.

Note the optionally stressed-spokes or "rigid-spokes" 74, a plurality of such spokes 74 connected at adjustable tension spoke ends 78 and further comprising threaded spoke tips 92 which threadably insert at the upper portion of center frame support or center hub 80 (having main center bore) into threaded bores 76 arrayed therein. Said rotating rim 5*b* can be further described as a rotatable-rim gaming wheel frame 5*b* that is made of any suitable rigid structural material but preferably of carbon fiber, a frame that is in the likes of a "high-quality" carbon fiber racing bicycle wheel frame that is extremely strong and very easy to spin because of its sleekness and very low weight to strength ratio—The frame outer edges could be convex or concave also, rather than the weaker flat strip loop structure as shown. Note that these spokes are adjustable by turning the said spoke ends 78 wherein an Allen key, Torx, or any other screwdriver end, including bolt or nut fastener may adjust the tension and "trueness" of the said rim 5*b*. These said spokes 74 could be also of a rigid form with an I-beam of tubular or ribbed type for strength far superior to steel—up to five times, pound for pound—adding even more safety and other obvious advantages that such less weight would have not only for W of F contestants but for transport of such wheels, the entire mechanism being documented as weighing in the 4,000 lb range.

Figure 3:
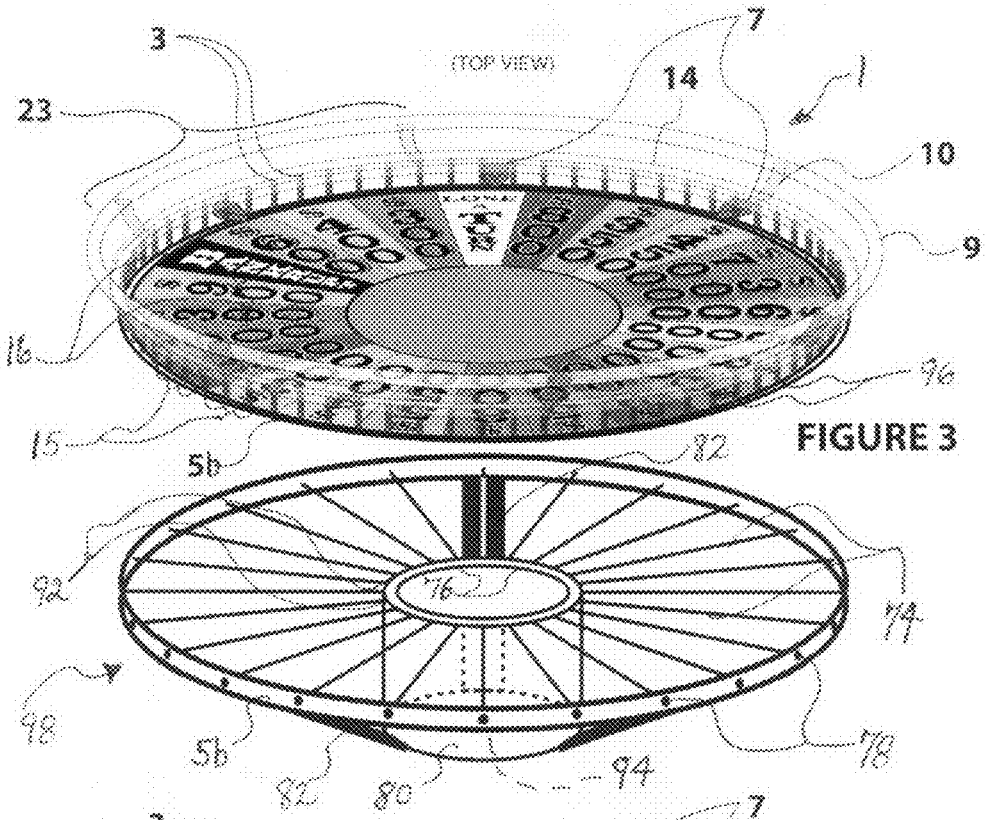
FIG. 3 is an exploded perspective view New Improvement Art 2 of the hand grip system and spoked-frame rotating rim gaming wheel new art of the present invention.

The said rim 5*b* may additionally include support arms 82 preferably underneath in a minimalist a minimalist designed three-point, three-arm contact attachment as depicted in FIG. 3 lower half exploded perspective illustration. As well, it should be quite obvious to one skilled in the art to add more said supports arms 82 or substitute any supportive structure that take the place of the said arms 82, and also include a simple and lightweight bearing system that utilizes any size said bore 94 and arrange bearings and a fixed or rotating shaft in conjunction therewith that can execute the rotation of the subject invention, including the rotatable electrical connectivity such a rotating board would require. For example, a rotatable shaft that has a flange at the upper end could substitute for the center frame support or hub 80 and function the same. All of the above said components form the frame assembly 98. This innovation would provide an even more simplified New Art 2 structure disclosed in the discussion following of an optional stationary wheel game board in conjunction with a rotating said, novel, annular grasping member 9 of this and the former said patent applications.

Most of these types of said gaming wheels have a game board base 5 or rim into which said pins may be fixed, providing rigidity to the entire wheel apparatus' structure. Upwardly jutting said support arms 10, aka., annular graspable member support means 10 may be one of many support means used to rigidly support said annular grasping member 9. It is to be noted that the said pins 3 bases 96 would not have to be fixedly attached to the said base rim 5, but rigid, rotating spoked rim 5*b* may take the place of both said rim means 5, 5*b*, and the said pins 3 could be affixed directly thereon, as readily, making the structure even lighter and more efficiently constructed.

Converting such a similar, "stress-spoked" structure to replace the heavy wheel 'base" presently in use on Games Shows, for example Wheel of Fortune would drop the weight to about $1/5^{th}$ of what it is now and make manual spinning of it by contestants—even still keeping the present 9" spikes (which the above former application does efficiently replace), making even the present unsafe W of F wheel far easier, though not eliminating its inherent systemic dangers, as fully discussed and achieved in the former application). However, the new weight and structure reducing art herein makes also an extremely simple, elegant and even more user-friendly improvement for the novel manual gripping means of former said application noted above.

Figure 5:
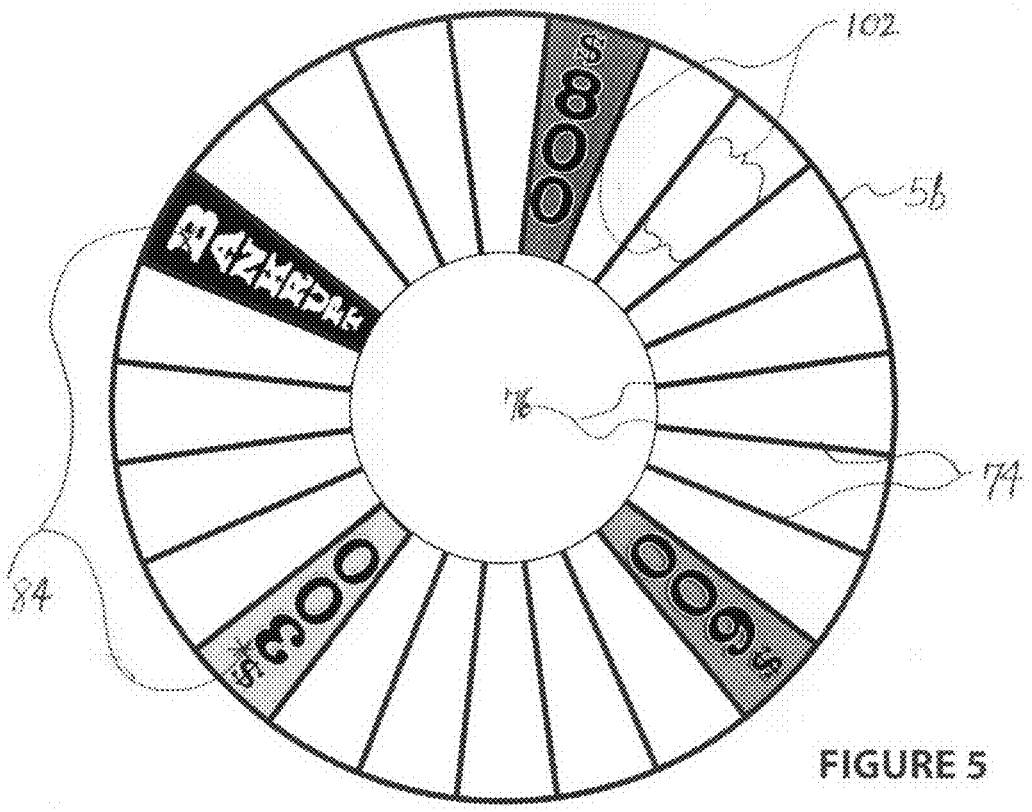
FIG. 5 is a New Improvement Art 3 top perspective view of a portion of the spoked-frame rotating rim gaming wheel of FIG. 3.
Figure 6:
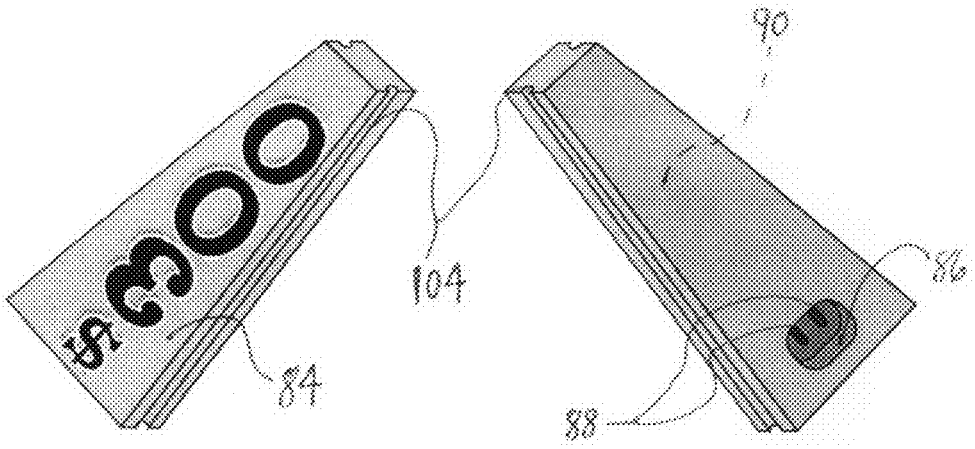
FIG. 6 is an exploded perspective view of the modular play wedge pieces of FIGS. 3, 4 and 5.

Moreover, the said information fields 16 that are defined by said sectors 15 can be more 3-dimensionally modified into "Snap-Fitting" modular wedge detachable pieces 84, aka., "snap-fitting" and/or modular electronic-plug-in game play wedge pieces 84 that are detachable and re-attachable, and can be inserted into and/or onto the said spokes 74 of the preferably the carbon fiber frame assembly 98 using very many obvious different means of attachment now that the applicant has taught the "individualizing" of them 84, or isolating them 84 as shown in FIG. 5 and FIG. 6. For example only one of many possible attachment means depicted is simply to place receiving grooves 104 in the sides of said modular play wedge pieces 84 thereof that would receive said spokes 74 in assembly. As they are made by flexible, preferably foam coated by a vinyl or even Kevlar® type material for tear resistance, comprising "mini-frames" which they could be "squeezed" in and out the spoke captive wedge-positions 102 for cleaning or touch-up, rather than the touch-up artist having to lean over the Wheel to work on them. Many other obvious ways to attach, such as Velcro (located at either end of the said "snap-fitting" and/or modular electronic-plug-in game play wedge pieces 84), or hook, various clipping or clamping means, even magnets inside the foam clinging to the steel spokes are possible. Of course, though the following are not shown, if one used webbing also of a rigid form with an I-beam of tubular or ribbed type for the said spokes 74 the said wedge pieces 84 could have conformable molded shapes to accommodate such, as well. A frame base that was mostly of a flat disc with punched or cut out areas to form fit said snap in wedges 84 could be used, too. Finally, the said wedges 84 could be a hard material, such as a mini-frame with webbing over it and much thinner and still function the same modular ways shown in New Improvement Art 3 in FIGS. 5 and 6, as it should be obvious to one skilled in the present art, to see such modifications and others not mentioned.

Note FIG. 6 modular plug cavity 86 including modular plug prongs 88 that further connect to a rotatable electric apparatus (not shown) and a female adaptor thereon in the event it is desired to provide lighting features or other electronic internal assembly 90 therein. As well, this feature makes it quite simple for repair of burned out or damaged electronics without the hassle of having to be bound to the said wheel's 1 structure to work on some of the electronics therein. With all of the above light weight wedges 84 combined with all the other lightweight componentry described in this and the former application, the said wheel system 23 becomes extremely light and simple to construct and maintain, and most importantly, manually rotate in a very safe way for the user.

The new art herein improves further the art of the former said application by also disclosing in addition, an optional stationary wheel board base or platform 100 in combination with a modified, said rotatable gaming wheel graspable member 9, of several variations and adaptations to the former said application art. This said wheel system 23 modified would include one or more said "flipper-indicators" 7 that also rotate with the said rotatable gaming wheel graspable member 9 that is further modified to accommodate such re-positioning and locating of said flippers 7 onto the said rotatable gripping means or annual graspable member 8 of the former application.

Figure 2:
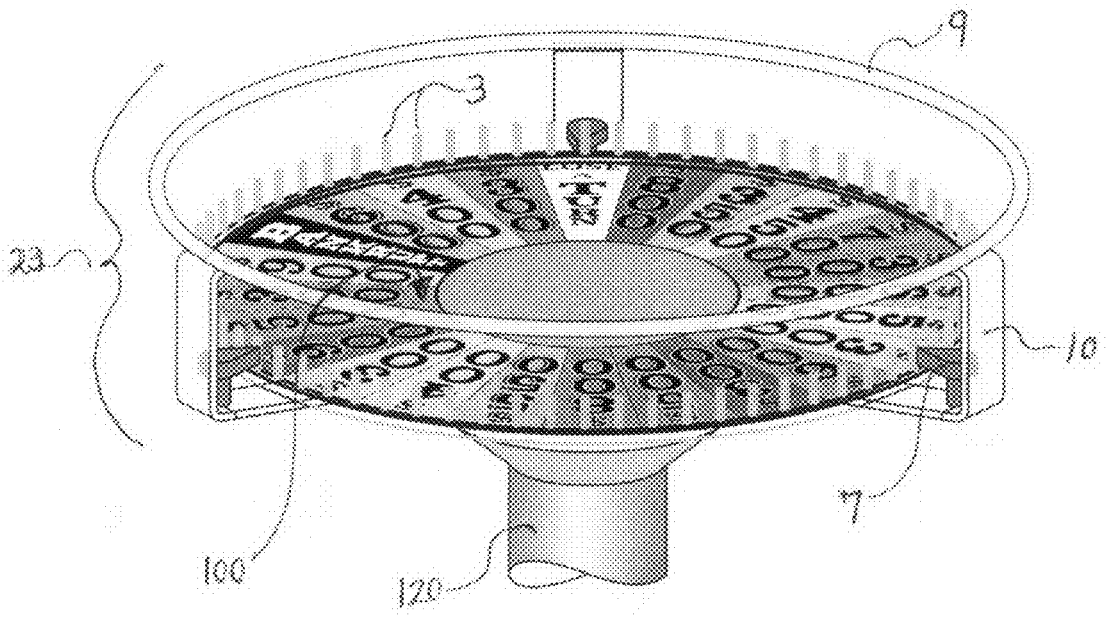
FIG. 2 is an assembled perspective view New Improvement Art 1 of of the hand grip system and stationary gaming wheel new art of the present invention.

Noting FIGS. 1 and 2 in particular, designated New Improvement Art 1, note hand grip system 23 comprising gaming wheel 1 which comprises a plurality of sectors 15 having informational fields 16, such fields identifying to the wheel user instruction, or in this case the money amount or prize to be received, usually upon meeting the game conditions and criteria. The main key improvement, among many other improvements being that the said Wheel 1 is fixed rigidly, and non-rotatably to stationary wheel center support 112, that in turn connect rigidly, non-rotatably to lower fixed support 120; said support 120 further comprising rigid connecting inner surface 106, which said connecting surface 106 is matable with a rigid connecting outer surface 110 of said wheel center support 112. Upwardly jutting said support arms 10, aka., said annular graspable member support means 10 may be one of many support means used to rigidly support said annular grasping member 9 in the New Art of FIG. 1, however it is to be noted that said support arms in FIG. 1 are rigidly fixed to a modified annular graspable member base 108 that comprises a base inner bearing surface 118 that is also rotatably connected with respect to the said rigid connecting outer surface 110 of said wheel center support 112 said base. Said member base 108 is also rotatably connected to the support bearing surface 116 of said lower support 120, and all the parts are arranged so that the said annular grasping member support means or arms 10 of this embodiment with its componentry described above can be manually rotated with respect to a stationary said Wheel 1 and stationary said lower fixed support 120. It should be obvious to one skilled in this art or actually in any mechanical art to find various alternate structural means to co-join the said Wheel 1 with the said lower fixed support 120 while permitting the said annular graspable member 9 (and its said components) to rotate freely with respect the said above rigid parts.

It should be noted that said annular grasping member support means or arms 10 as shown are "underneath" the actual said game wheel or game board base 100, but alternative may be above the said Game board 100 and if made of a clear polymer or even very thin opaque structure would be non-obstructive to viewing the said sectors 15, but are preferably located below the said game board base or platform 100. In other words, said rotatable, annular graspable member 9 may easily both rotatably intervene and rotatably move with respect to both said stationary gaming wheel 1 and said lower, non-rotatable fixed support 120. But, as well, said rotatable, annular graspable member 9 may easily both rotatably attach to said stationary wheel center support 112 ABOVE said stationary gaming wheel 1 and rotatably move with respect to both said stationary gaming wheel 1 and said lower, non-rotatable fixed support 120. As this change is obvious by simply replacing the same said annular graspable member 9 with said wheel 1, it is not illustrated in the drawings. As well, it is obvious then, in this arrangement that the said sector identification members 7 aka., as "flipper indicators" can then be placed on the INSIDE of the said arrayed stop position means 3 or pins, aka. spikes 3 and therefore would point outward from INSIDE the said stationary wheel board 100. Again, no drawing is necessary since this just involves re-positioning the said flippers 180 degrees from their present position and moving them further toward the center of the said wheel board to simply engage the pins 3 on the opposite side of the wheel's 1 circumference with its flipper points 119 pointing outward rather than inward, as in FIG. 1 and. FIG. 2 show the inward pointing positions.

Figure 4:
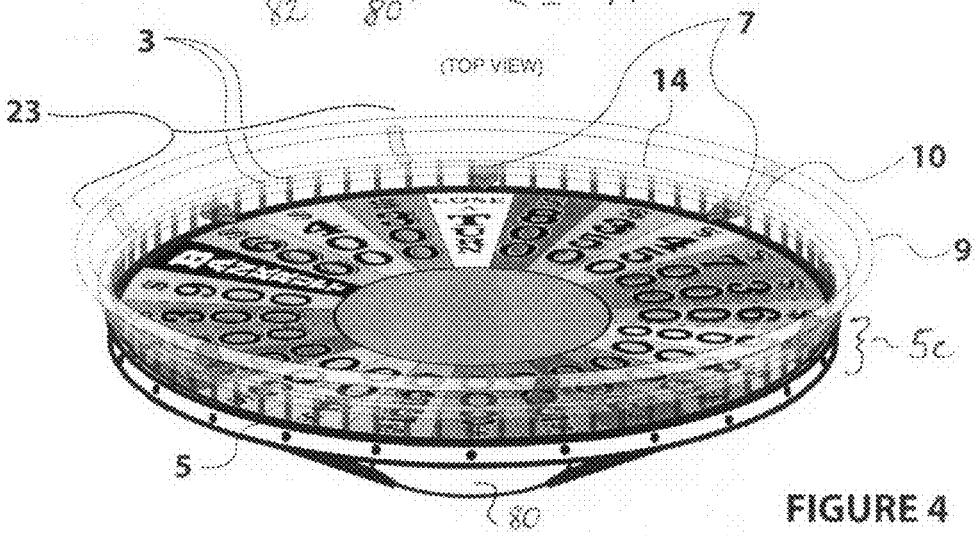
FIG. 4 is an assembled perspective view New Improvement Art 2 of the hand grip system and spoked-frame rotating rim gaming wheel new art of the present invention.

It is to be noted that the said pins 3 could be affixed directly thereon said base rim 5, noted further herein as fixed base rime 5*c*, and have similar webbed light frame structure embodiment as discussed in FIGS. 3 and 4, thus reducing weight, as well, this non-rotating, stationary wheel embodiment. Annularly arrayed stop position means 3 are typically used in the art category of this invention and can be comprised of simple pins, whereby as the wheel user spins the said rotatable gaming wheel 1 said fields 16 are identified when sector identification members 7 aka., as "flipper indicators" or just "flippers"7, which can also be called or understood as spring-clicking flipper indicators, pass over the said pins 3 and eventually stop. One of the essential structural differences of New Improvement Art 1 over the former said application, however, is that the said flippers 7 are NOT fixed with respect to former said rotating gaming wheel 1, but they ARE fixed with respect to the said annular graspable member's said support 10, as they are upon and on-board annular grasping members 9 structure, band the said flippers 7 are "oscillatingly" attached at flipper bases 114, these bases preferably being integral to the annular graspable member support means 10. These said flippers 7 can have a multitude of alternative relationships, structures, aesthetics and functional modifications with respect to the said Wheel, themselves and their previously discussed usages. For example, only one flipper 7 may needed to notify, signal, designate or represent one of the three contestants, since a combined, single red, yellow and blue multi-light emitting means can be put into one flipper to function just like three individual, preferably different colored flippers would, identifying each of the contestants. Each said flipper 7 or all three said flippers 7 could comprise different color light sources electrically actuable through remote control or direct hardwire. Only one said flipper 7 need comprise three different color light sources electrically actuable through remote control or direct hardwire. This would mean that the other two flippers would become unnecessary. Of course for balanced look, and even "feel" of wheel and pleasing aesthetics, though, three colors, one color on each of three flippers 7, preferably spaced 120 degrees apart on the said annular graspable member's said support 10, may be preferable and simpler to identify and designate the contestant, and the particular said sector 15 to play. No rotatable electrical connector would be needed then, (unless it was purposed to light the said annular graspable member 9, as well-described in the former said application).

It is to be understood that the form of the invention herewith shown and described above is to be taken as preferred embodiments. Various changes may be made in the shape, size and arrangement of parts, for example: other equivalent elements may be substituted for those illustrated and described herein, parts and elements may be reversed, and certain features of the invention n\maybe utilized independently of the use of other features, all without departing form the spirit or scope of the invention, as defined in the subjoining claims.

What is claimed is:

1. A hand grip system for safely, manually grasping and spinning gaming wheels comprising:

a rotatable gaming wheel having a plurality of annularly arrayed stop position means affixed near an outer board diameter of said gaming wheel; said gaming wheel further comprising a game board base whereupon are sectors which are randomly chosen as a user spins said gaming wheel; said game board base further comprising a gaming wheel support that comprises a spoked structure, wherein spokes of said spoked structure are located under said sectors such that said sectors are supported by said spokes;

at least one sector identification member, whereby at least one said annularly arrayed stop position means may be randomly selected as a gaming wheel user manually spins said gaming wheel;

an annular graspable member affixed to at least one of said annularly arrayed stop position means so as not to inhibit function of said sector identification member as said rotatable gaming wheel is spun.

2. The invention as recited in claim #1 wherein the said spoked structure comprises a plurality of spokes joining a central hub at one end, the other spoke ends being connected to a frame rim.

3. The invention as recited in claim #2 wherein the said spoked structure further comprises support arms connecting both said hub and said frame rim in structural support of said game board base.

4. The invention as recited in claim #2 wherein the said spokes joining a central hub comprise hub end spokes with threaded tips that may seat into said central hub, and wherein said spokes' other ends have adjusting means to turn said spokes, similarly to that adjusting made on bicycle wheels; and wherein said frame rim may further comprise support arms preferably underneath the perimeter of said gaming wheel frame rim in a minimalist designed three-point, three-arm contact.

5. The invention as recited in claim #2 wherein the said spoked structure further comprises a lightweight, spoked-frame, rotating-rim gaming wheel frame that may comprise "snap-fitting" and/or modular detachable electronic-plug-in game play wedge pieces.

6. The invention as recited in claim #5 wherein the said "snap-fitting" and/or modular electronic-plug-in game play wedge pieces may be constructed using a foam or sponge-type rubbery material and wherein the said spokes further comprise captive wedge positions onto which said "snap-fitting" and/or modular electronic-plug-in game play wedge pieces squeeze into or snap into place within the said captive wedge positions.

7. The invention as recited in claim #5 wherein the said "snap-fitting" and/or modular electronic-plug-in game play wedge pieces may further have groove means within their structure and wherein their attachment means to the said spokes may comprise well know standard attachment systems and methods.

8. The invention as recited in claim #5 wherein the said "snap-fitting" and/or modular electronic-plug-in game play wedge pieces may further have at least one plug cavity and plug prongs, and lighting features with other electronic internal assembly; said wedge pieces may also comprise a flexible vinyl type film sheathing.

9. The invention as recited in claim #2 wherein the said spoked structure further comprises a lightweight, spoked-frame, rotating-rim gaming wheel frame that is comprised of a spoked structure having a tubular or ribbed type carbon fiber said spokes and wherein said frame rim also is carbon fiber construction, having a convex outer perimeter.

10. A hand grip system for safely, manually grasping and spinning gaming wheels comprising:

a stationary gaming wheel having a plurality of annularly arrayed stop position means affixed near the outer board diameter of said gaming wheel and also comprising a stationary wheel center support affixed thereon; said gaming wheel further comprising a game board base whereupon are sectors;

a lower non-rotatable, fixed support further comprising a rigid connecting surface thereon, where onto said stationary gaming wheel non-rotatably attaches;

a rotatable, annular graspable member rotatably intervening and rotatable with respect to both said stationary gaming wheel and said lower, non-rotatable fixed support; said annular graspable member including at least one sector identification member that also rotates with the said rotatable annular graspable member, as a gaming wheel user rotates said annular graspable member;

wherein the sector identification member rotates relative to the sectors such that the sectors remain stationary and the identification member rotates.

11. The invention as recited in claim #10 wherein the said at least one sector identification member engages said annularly arrayed stop position means as said rotatable, annular grasping member is rotated; said at least one sector identification member further comprising three different color light sources electrically actuable through remote control or direct hardwire; and wherein said annular graspable member further comprises a base having a bearing surface.

12. The invention as recited in claim #10 wherein the said at least one sector identification member is further defined as three sector identification members, each member spaced 120 degrees apart and each member also comprising one of three colors, designating both the contestant and the said sector the contestant is to play.

13. The invention as recited in claim #10 wherein the said stationary gaming wheel further comprises a spoked structure having a tubular or ribbed type carbon fiber said spokes and wherein said frame rim also is carbon fiber construction, having a convex outer perimeter.

14. The invention as recited in claim #10 wherein the said annular graspable member further comprises an annular graspable member support means whereon is oscillatingly affixed at least one said sector identification member.

15. The invention as recited in claim #11 wherein the said stationary wheel center support further comprises a bearing surface thereon; and wherein said lower fixed support comprises an internal bearing surface thereon that further rotatably engages said rotatable, annular graspable member and its said bearing base surface.

16. The invention as recited in claim #10 wherein the said hand grip system may further comprise light emitting means within the said annular grasping member.

17. The invention as recited in claim #10 wherein the said game board base further comprises a spoked structure further comprising a lightweight, spoked-stationary gaming wheel frame; said gaming wheel frame may further comprise detachable, "snap-fitting" and/or modular electronic-plug-in game play wedge pieces attached thereto.

18. A hand grip system for safely, manually grasping and spinning gaming wheels comprising:

a rotatable gaming wheel having a plurality of annularly arrayed spikes affixed near the outer board diameter of said gaming wheel; said gaming wheel further comprising a game board base whereupon are sectors which are randomly chosen as a user directly grabs said spikes rotates said gaming wheel; said game board base further comprising a gaming wheel support that comprises a spoked structure;

at least one sector identification member, whereby at least one said annularly arrayed stop position means may be randomly selected as a gaming wheel user manually spins said gaming wheel; wherein said at least one sector identification member has at least one flipper that pivots about an axis that is both parallel to and radially displaced from an axis of said rotatable gaming wheel.

19. A hand grip system for safely, manually grasping and spinning gaming wheels comprising:

a stationary gaming wheel having a plurality of annularly arrayed stop position means affixed near the outer board diameter of said gaming wheel and also comprising a stationary wheel center support affixed thereon; said gaming wheel further comprising a game board base whereupon are sectors;

a lower non-rotatable, fixed support further comprising a rigid connecting surface thereon, where onto said stationary gaming wheel non-rotatably attaches;

a rotatable, annular graspable member rotatably affixed ABOVE said stationary gaming wheel and further rotatable with respect to both said stationary gaming wheel and said lower, non-rotatable fixed support; said annular graspable member including at least one sector identification member that also rotates with the said rotatable annular graspable member, as a gaming wheel user rotates said annular graspable member;

wherein the sector identification member rotates relative to the sectors such that the sectors remain stationary and the identification member rotates.

20. The invention as recited in claim #19 wherein the said sector identification members are affixed upon the INSIDE of the said arrayed stop position means, pointing outward from INSIDE the said stationary wheel board's circumference; and wherein the said at least one sector identification member is further positioned upon said rotatable annular graspable member, with its flipper points pointing outward rather than inward.

* * * * *